US010801086B2

(12) United States Patent
Dubois

(10) Patent No.: US 10,801,086 B2
(45) Date of Patent: Oct. 13, 2020

(54) METHOD AND DEVICE FOR REACTION CONTROL

(71) Applicant: COCKERILL MAINTENANCE & INGENIERIE S.A., Seraing (BE)

(72) Inventor: Michel Dubois, Boncelles (BE)

(73) Assignee: COCKERILL MAINTENANCE & INGENIERIE S.A., Seraing (BE)

( * ) Notice: Subject to any disclaimer, the term of this patent is extended or adjusted under 35 U.S.C. 154(b) by 145 days.

(21) Appl. No.: 15/561,525

(22) PCT Filed: Mar. 23, 2016

(86) PCT No.: PCT/EP2016/056305
§ 371 (c)(1),
(2) Date: Sep. 26, 2017

(87) PCT Pub. No.: WO2016/156125
PCT Pub. Date: Oct. 6, 2016

(65) Prior Publication Data

US 2018/0363094 A1 Dec. 20, 2018

(30) Foreign Application Priority Data

Apr. 2, 2015 (EP) ..... 15162341
Aug. 31, 2015 (EP) ..... 15183169

(51) Int. Cl.
*C21D 9/56* (2006.01)
*C21D 9/00* (2006.01)
(Continued)

(52) U.S. Cl.
CPC ..... *C21D 9/561* (2013.01); *C21D 9/005* (2013.01); *C21D 9/56* (2013.01); *C21D 9/562* (2013.01);
(Continued)

(58) Field of Classification Search
CPC ..... C21D 9/005; C21D 9/56; C21D 9/561; C21D 9/562; F27B 9/04; F27B 9/045; F27B 9/14; F27B 9/28; F27B 9/36; F27D 7/06
(Continued)

(56) References Cited

U.S. PATENT DOCUMENTS 5,137,586 A * 8/1992 Klink ..... C21D 1/767 148/529
8,192,566 B2 * 6/2012 Dulcetti ..... C21D 9/52 148/633
(Continued)

FOREIGN PATENT DOCUMENTS

BE 1014997 A3 8/2004
CN 103849825 A 6/2014
(Continued)

*Primary Examiner* — Jessee R Roe
*Assistant Examiner* — Michael Aboagye
(74) *Attorney, Agent, or Firm* — Leydig, Voit & Mayer, Ltd.

(57) ABSTRACT

A continuous annealing furnace for annealing steel strips has a reaction chamber wherein the steel strips are transported vertically, the reaction chamber having openings supplied with a reactant, also called reactant openings, located at the top or at the bottom of the reaction chamber, wherein the reaction chamber further has other openings supplied with an inert gas, also called inert gas openings, the inert gas openings being located on the lateral sides of the reaction chamber.

16 Claims, 5 Drawing Sheets

(51) Int. Cl.

| | |
|---|---|
| ***F27B 9/04*** | (2006.01) |
| ***F27D 7/06*** | (2006.01) |
| ***F27B 9/14*** | (2006.01) |
| *F27B 9/28* | (2006.01) |
| *F27B 9/36* | (2006.01) |
| *F27D 99/00* | (2010.01) |

(52) U.S. Cl.
CPC ..... *F27B 9/04* (2013.01); *F27B 9/045* (2013.01); *F27B 9/14* (2013.01); *F27D 7/06* (2013.01); *F27B 9/28* (2013.01); *F27B 9/36* (2013.01); *F27D 99/0073* (2013.01)

(58) Field of Classification Search
USPC ..... 266/44, 249, 250, 252, 111, 103; 148/661, 664, 652, 657
See application file for complete search history.

(56) References Cited

U.S. PATENT DOCUMENTS

| | | | | |
|---|---|---|---|---|
| 8,636,854 | B2 * | 1/2014 | Leuschner | C23C 2/02 148/277 |
| 9,388,484 | B2 * | 7/2016 | Takahashi | C23C 2/02 |
| 2010/0062163 | A1 * | 3/2010 | Bordignon | C23C 2/02 427/321 |

FOREIGN PATENT DOCUMENTS

| | | | |
|---|---|---|---|
| EP | 2010690 | B1 | 2/2010 |
| EP | 2857532 | A1 | 4/2015 |
| EP | 2960348 | A1 | 12/2015 |
| FR | 2375334 | A1 | 7/1978 |

* cited by examiner

METHOD AND DEVICE FOR REACTION CONTROL

CROSS-REFERENCE TO RELATED APPLICATIONS

This application is a U.S. national stage application under 35 U.S.C. § 371 of International Application No. PCT/EP2016/056305, filed on Mar. 23, 2016, and claims benefit to European Patent Applications No. 15 162 341.0 and 15 183 169.0, respectively filed on Apr. 2, 2015, and Aug. 31, 2015. The International Application was published in English on Oct. 6, 2016, as WO 2016/156125 A1 under PCT Article 21(2).

FIELD

The invention relates to a device and a method for controlling the surface reaction on steel sheets transported in a continuous galvanizing or annealing line.

BACKGROUND

High strength steel grades generally comprise high contents of elements like silicon, manganese and chromium (respectively typically between 0.5 and 2%; 1.5 and 6%, 0.3 and 1% in wt) making them difficult to coat because an oxide layer of those elements is formed during the annealing preceding the dipping in the galvanizing bath. This oxide layer harms the wetting ability of the steel surface when submerged in the bath. As a result, uncoated areas and a poor adhesion of the coating are obtained.

A well-known method to improve the wetting of these steel grades consists in fully oxidizing the steel surface in a specific chamber when the steel has a temperature typically between 600 and 750° C. The resulting oxide layer comprises a high amount of iron oxides which are then reduced during the end of heating and holding section of the annealing furnace and the following thermal treatment. The target is to obtain an oxide thickness between around 50 and 300 nm, what corresponds to an iron oxide below 2 gr/m$^2$.

There are different ways to oxidize the steel surface before the reduction step. For example, this oxidation can be performed in a direct fired furnace running the combustion with air excess. Another way consists in making this oxidation in a dedicated chamber located in the middle of the annealing furnace and supplied with a mixture of nitrogen and an oxidant. Such implementation is described in the patent EP 2 010 690 B1 and in FIG. 1. The oxidation section is separated from the other parts of the annealing furnace by seals to minimize the introduction of the oxidant in the first and final sections.

The formation of the oxide layer must be carefully controlled to avoid the formation of too thick or too thin layers. In the first case, the reduction in the final part of the furnace can be incomplete due to lack of time. It is also known that, in that case, the oxide can stick to the furnace rolls and generate defects. In the second case, the oxide layer is not efficient enough since the oxidation of the alloying elements cannot be inhibited sufficiently and thereby the wetting in the liquid metal bath is not sufficiently improved.

The formation of the oxide layer is guided by three main parameters: strip temperature, oxygen concentration in the atmosphere of the chamber and the transport of that oxygen to the steel surface. Because the edges of the sheet have not the same boundary conditions and turbulence as the center of the sheet, the transport of the oxidant to the edge is different. Similarly to higher edge cooling in the processing line, the oxidation of the edge used to be higher. The width impacted by this over oxidation is in the range from 1 to 10 cm, depending on the design of the oxidizing chamber and on the process parameters used.

To obtain an uniform oxide thickness, it is therefore needed to have a controllable system which can also accommodate the frequent strip width change in a continuous galvanizing line (typically from 900 to 2000 cm).

Mechanical systems can be designed with variable injection sections but this method is not industrially reliable because of the high temperature of the strip and the induced thermal expansion of the material. This becomes a real problem, knowing also that the oxidation chamber can only be used occasionally since all the steel sheets do not need such an oxidation process.

SUMMARY

An aspect of the invention provides a continuous annealing furnace for annealing steel strips, the continuous annealing furnace comprising: a reaction chamber in which the steel strips can be transported vertically, the reaction chamber including reactant openings supplied with a reactant, the reactant openings being located at a top or bottom of the reaction chamber, wherein the reaction chamber further includes inert gas openings supplied with an inert gas, the inert gas openings being located on lateral sides of the reaction chamber.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
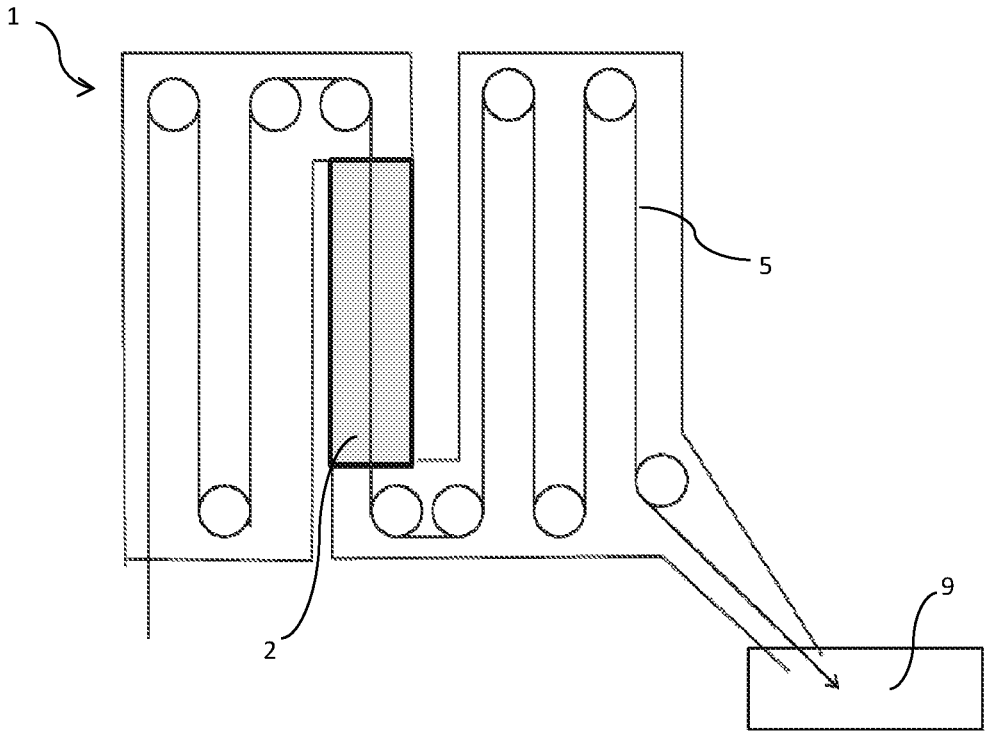
FIG.1 (Prior Art)
FIG. 1 schematically represents an annealing furnace comprising an oxidation section according to the state of the art.

An aspect of the present invention provides a continuous annealing furnace for annealing steel strips comprising a reaction chamber wherein the steel strips are transported vertically, said chamber comprising openings supplied with a reactant, also called reactant openings, located at the top or at the bottom of the reaction chamber, wherein the reaction chamber further comprises other openings supplied with an inert gas, also called inert gas openings, said inert gas openings being located on the lateral sides of the reaction chamber.

According to particular preferred embodiments, the furnace according to the invention further discloses at least one or a suitable combination of the following features:

- the inert gas openings are located in such a way as to be downstream of the reactant flow from the reactant openings;
- it comprises one or several inert gas openings on each lateral side of the reaction chamber;
- it comprises means for controlling the flow and the temperature of the inert gas;
- it comprises means for separately controlling the flow of the inert gas on each lateral side of the reaction chamber;
- the reaction chamber comprises extraction openings for avoiding an overpressure inside the reaction chamber, said extraction openings being located in such a way as to be downstream of the reactant flow and of the inert gas flow respectively leaving the reactant openings and the inert gas openings;
- the distance between the lateral sides of the reaction chamber and the edges of the steel strip is comprised between 75 and 220 mm, preferably between 100 and 200 mm and more preferably is of 100 mm;
- the reaction chamber comprises a reactant opening facing each side of the steel strip
- the reaction chamber is an oxidation chamber and the reactant is an oxidant.

An aspect of the invention also provides a method for controlling a surface reaction on a steel strip running vertically through the reaction chamber of the furnace as described above, comprising a step of injecting laterally an inert gas in the reaction chamber and a step of injecting a reactant upstream of the inert gas flow in said chamber.

According to particular preferred embodiments, the method according to the invention further discloses at least one or a suitable combination of the following features:

- the reaction chamber is an oxidation chamber and the reactant is an oxidant, the oxygen content of the oxidant being comprised between 0.01 and 8% and preferably between 0.1 and 4% in volume;
- the inert gas flow is comprised between 5 and 70 $Nm^3/h$ and preferably between 10 and 60 $Nm^3/h$;
- the inert gas temperature is between 200 and 50° C. below the steel strip temperature when the reaction of the steel strip is performed by injecting the reactant at the top of the reaction chamber and wherein the inert gas temperature is between 200 and 50° C. above the steel strip temperature when the reaction of the steel strip is performed by injecting the reactant at the bottom of the reaction chamber;
- there is a step of extracting a gas comprising the inert gas and the reactant, the extracted flow being calculated based on the difference of pressure between the inside of the reaction chamber and the other parts of the furnace.

Finally, an aspect of the invention also provides a steel strip obtained by the method as described above wherein the steel strip has at the exit of the oxidation chamber an oxide layer with an increase of the mass per surface area between the value at the center of the strip and the maximum value at the edge of the strip inferior to 15% and preferably inferior to 10%.

An aspect of the invention aims to provide a device and a method to control the surface reaction of the edges of a sheet without mechanical system. The surface reaction can be any reaction that can occur in a section of an annealing furnace like a reduction reaction or a nitriding reaction, the section being supplied with the appropriate reactant. Indeed, the problem of formation of layers with a different thickness on the edges of the sheet exists regardless of the type of reactant. As an example, the method and the device are hereafter illustrated for a surface reaction occurring in an oxidation chamber supplied with an oxidant.

The annealing furnace comprises an oxidation chamber provided with means for modulating the oxygen concentration of the atmosphere in the regions close to the edges of the sheet. The oxidation chamber according to the invention can be used in a continuous galvanizing line and in a continuous annealing line without hot-dip galvanizing facilities. In this latter case, the uncoated steel sheet can be further pickled to remove the oxide layer formed during annealing.

Figure 2:
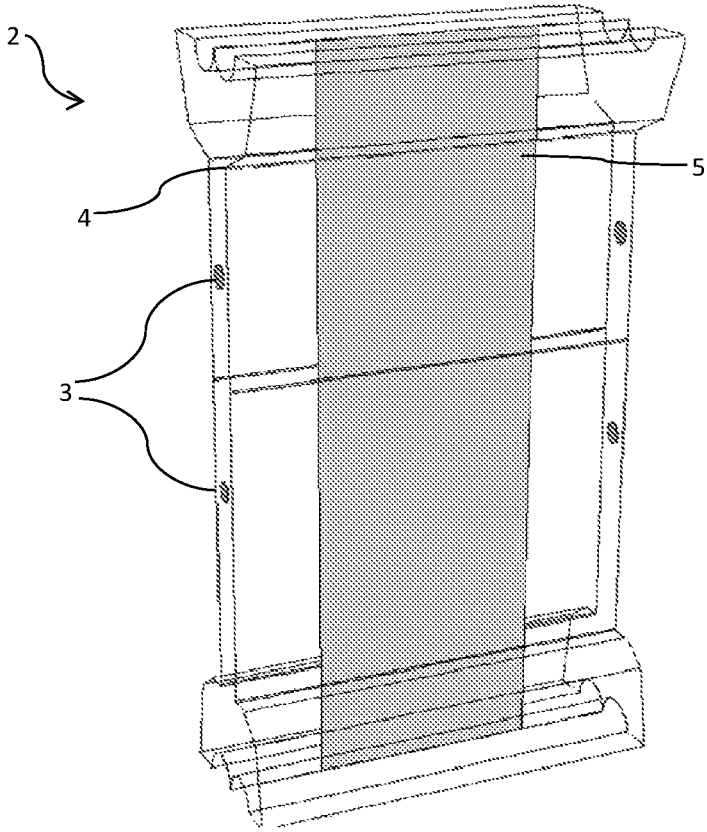
FIG. 2 schematically represents the oxidation chamber according to the invention with the lateral openings for injecting the inert gas.

The method according to an aspect of the invention consists in injecting an inert gas with a defined flow and temperature through the sides of the oxidation chamber. To this end and as shown in FIG. 2, the oxidation chamber 2 comprises lateral openings 3 for injecting the inert gas in addition to transversal openings 4 for injecting the oxidant medium, also called oxidant. In this way, the level of the oxidant transversally injected can be either increased or decreased in the edge area depending on the dilution rate resulting from the lateral injection of inert gas. In addition and as detailed below, the oxidation chamber can further comprise openings for extracting the fluid at the opposite side of the transversal openings in order to avoid an overpressure inside the chamber.

According to an embodiment of the invention, the lateral openings of the chamber can be in the form of holes and one, two or more than two holes can be provided in each lateral side of the chamber. According to other embodiments, the openings can be in the form of slots or any form appropriate for injecting a gas.

In addition, the oxidation chamber can be provided with means for separately controlling the flow of inert gas on each lateral side.

Figure 3:
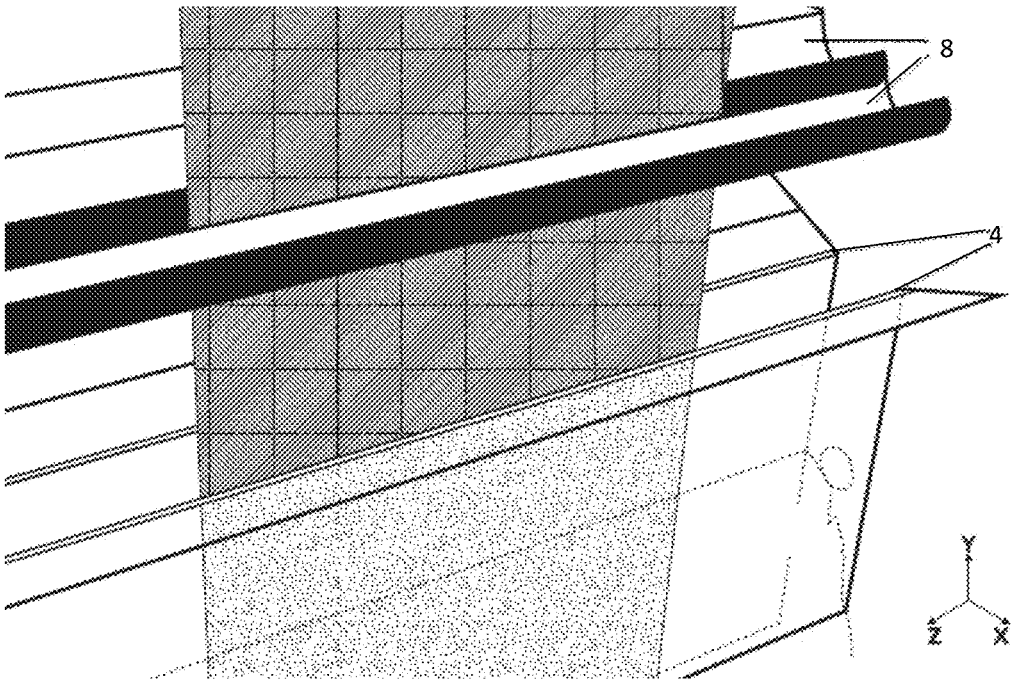
FIG. 3 represents the upper part of the oxidation chamber according to the invention with the transversal openings for injecting the oxidant.
Figure 4:
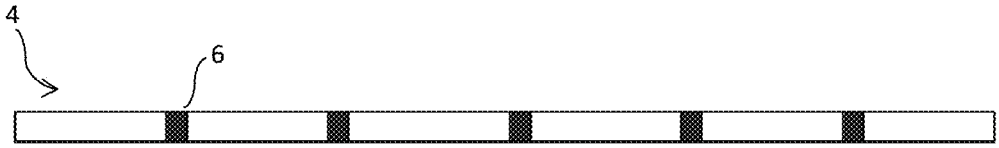
FIG. 4 represents a transversal opening of the oxidation chamber with a reinforcement according to one embodiment of the invention.

The transversal openings for injecting the oxidant gas through the chamber are preferably located at the top of the chamber for reasons explained below. An opening is located on each side of the sheet. According to an embodiment of the invention shown in FIG. 3, the transversal openings 4 are in the form of slots but they can have other shapes according to other embodiments. In addition, the opening 4 can be provided with reinforcement 6 to keep the opening geometry constant as represented in FIG. 4.

Figure 5:
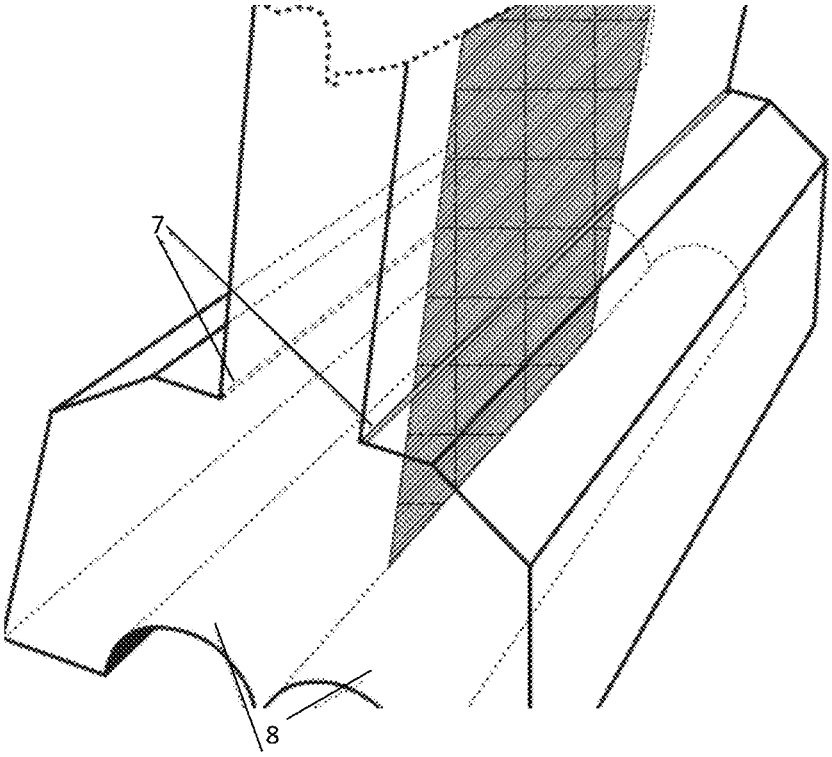
FIG. 5 represents the lower part of the oxidation chamber with extraction openings according to one embodiment of the invention.
Figure 6:
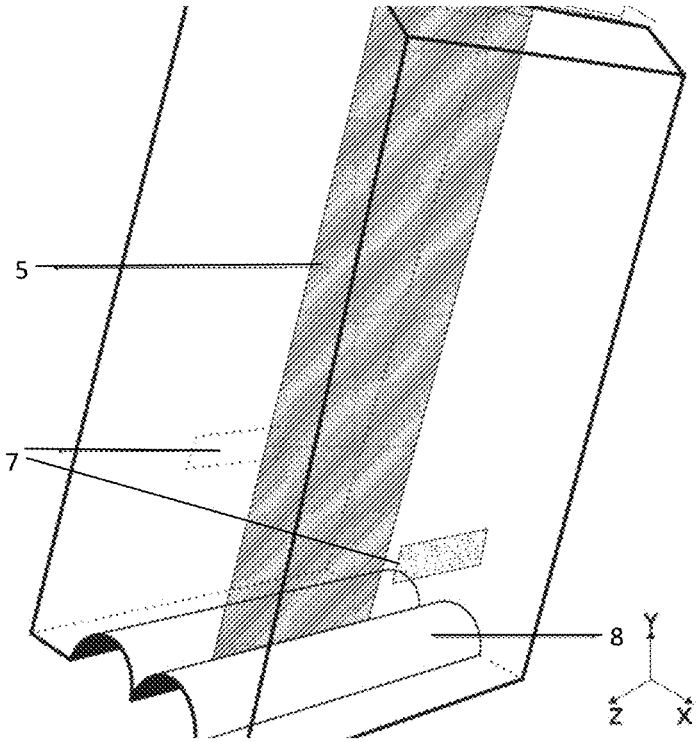
FIG. 6 represents the lower part of the oxidation chamber with extraction openings according to another embodiment of the invention.

On the opposite side of the transversal openings, i.e. at the bottom of the oxidation chamber if the oxidant injection is carried out at the top, the chamber comprises extraction openings 7 to reduce the pressure inside the chamber when the fluid is not recycled. They can be in the form of slots on each side of the sheet as shown in FIG. 5 or be round, square or rectangular openings as represented in FIG. 6.

The chamber further comprises rolls or similar sealing system at its entry and exit to separate the atmosphere of this chamber from the rest of the annealing furnace and so to minimize the flow of the oxidant in the other parts of the furnace. For sake of simplicity, only half of the rolls 8 being closest to the chamber are represented in FIGS. 3, 5 et 6. Moreover, the chamber is heat insulated but if required some heating devices can be added to compensate for heat losses.

As an example, typical dimensions of the oxidation chamber are the following. It is between 3 and 5 m long with a width that it is about 150 mm wider than the maximal strip width to run. A typical design is 2 m wide for a maximal strip width of 1850 mm. The minimal distance between the casing of the oxidation chamber and the strip is from 75 to 220 mm, preferably from 100 to 200 mm and more preferably of 100 mm.

As shown in FIG. 2, the steel sheet 5 passes vertically through the oxidation chamber 2. The sheet can move up or down depending on the global furnace layout. The oxidant gas composed of a mixture of $N_2$ and $O_2$ with an oxygen content between 0.01 and 8% and preferably between 0.1 and 4% in volume is injected through the transversal openings 4. The flow, the temperature and the concentration of the oxidant is controlled. The flow per side is typically comprised between 150 and 250 $Nm^3/h$ for a slot with 10 mm opening and 2 m long. The temperature of the mixture $N_2+O_2$ is between 200° C. and 50° C. below the strip temperature to take benefit of the buoyancy principle. Preferably, the mixture temperature is between 580 and 600° C. for a strip at 700° C. The gas colder than the strip moves down and, for this reason, the transversal openings are located at the top of the chamber. Because the oxygen is not consumed in the area next to the sides of the chamber and being outside of the strip edges, the concentration of $O_2$ is higher in those parts resulting in a thicker oxide layer on the edges of the sheets compared to the central part of the sheet. This is especially true on narrow sheets. To solve this problem, a small amount of pure inert gas like $N_2$ or Ar is injected downstream of the oxidant injection via the lateral openings of the chamber. The flow rate and temperature of the inert gas is controlled and adjusted depending on the strip grade, the strip width, the oxygen content and the flow of the main oxidant. The total flow is typically comprised between 5 and 70 $Nm^3/h$ and preferably between 10 and 60 $Nm^3/h$ per lateral side supplied through one or multiple openings. The fluid temperature is between 200° C. and 50° C. below the strip temperature to take again benefit of buoyancy principle. Preferably, the target is 580-600° C. for a strip at 700° C. Thereby, the inert gas flow also moves down.

The following simulation illustrates the efficiency of the method and device according to the invention to evenly distribute the oxide layer through the width of the sheet.

Figure 7:
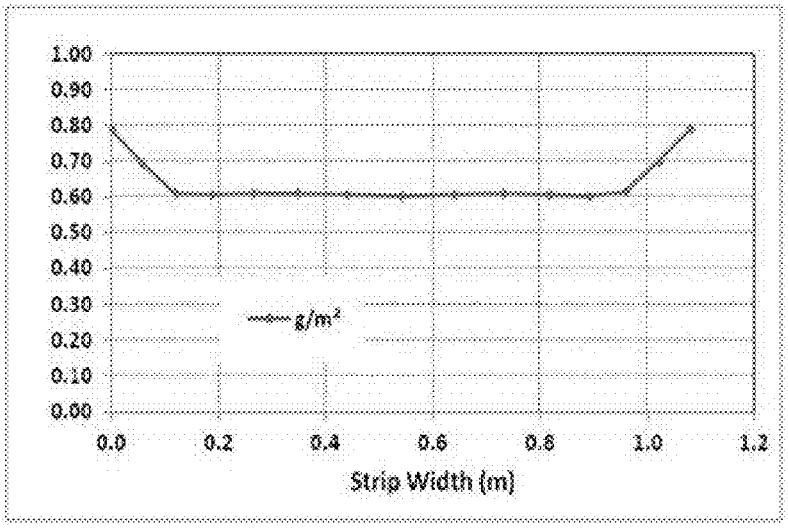
FIG. 7 represents the evolution of the mass per unit area of the oxide layer through the width of the strip when there is no lateral injection of inert gas.

Typical FeO formation on a 1050 mm wide strip of specific composition at 700° C. running at 120 mpm in an oxidation chamber being three meter long and two meters wide, with an oxidant flow of 160 $Nm^3/h$ per side at 600° C. and comprising 1% $O_2$ is represented in FIG. 7. On the edges of the sheet, the mass per surface unit of the oxide layer increases from about 30%.

Figure 8:
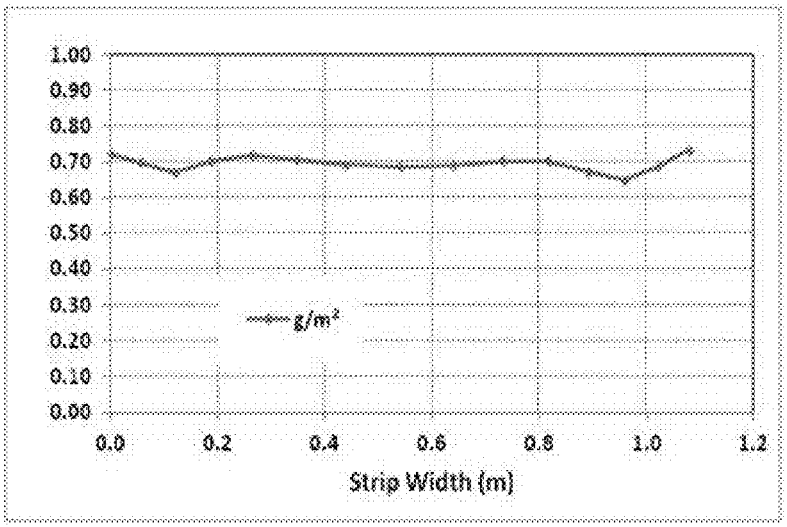
FIG. 8 represents the evolution of the mass per unit area of the oxide layer through the width of the strip when there is a lateral injection of inert gas.

For similar conditions but with an injection of 40 $Nm^3/h$ of inert gas at 600° C. on each lateral side of the chamber, the oxide uniformity is improved as shown in FIG. 8. In this case, the increase between the value at the center of the strip and the maximum value at the edge of the strip is inferior to 10%. According to the invention, the target is an increase inferior to 15% and preferably inferior to 10% between the center of the strip and the maximum value at the edge.

As already mentioned, for correct efficiency, the right flow and temperature of the main oxidant and of the inert gas need to be adjusted with the strip width and quality processed.

Figure 9:
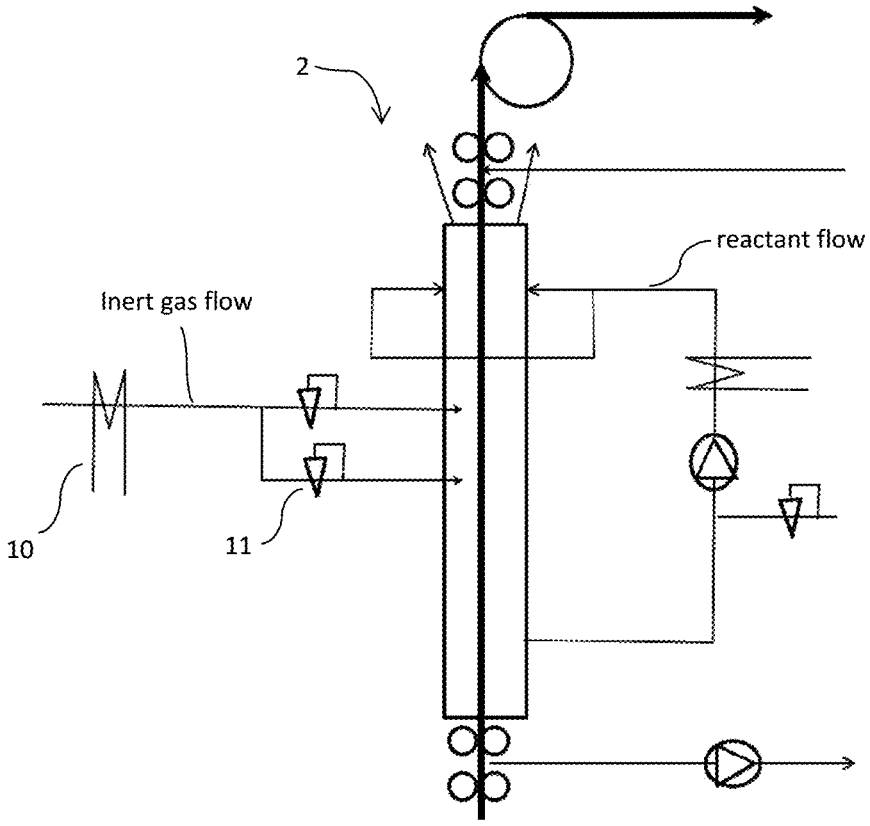
FIG. 9 represents according to the invention the control means for separately regulating the inert gas flow on each lateral side of the oxidation chamber and the control means for controlling the injection of the oxidant at the top of the oxidation chamber.

Each flow is controlled by control valves and flow meters. There is a temperature sensor and the temperature is reached by means of a heat exchanger using gas, electricity or other. The total gas injected (oxidant and inert) may be recycled or not. The pressure inside the chamber is controlled by means of fluid extraction in the sealing devices but can also be done by the extraction slots when the fluid is not recycled. This allows avoiding an overpressure in the chamber as well as a flow of the oxidant in the other parts of the furnace. The extraction flow is adjusted by control of the pressure inside the chamber versus that in the other parts of the furnace. A typical flow control may be done in agreement with the PID principle represented in FIG. 9. The oxide thickness is measured across the strip width by a dedicated system installed after the oxidation section which means outside of the chamber and eventually on each side of the strip.

The invention has been illustrated and described for an oxidation chamber with transversal openings located at the top of the chamber, the oxidant and the inert gas moving down because their temperatures are inferior to that of the strip. The description also covers the configuration with the transversal openings located at the bottom of the oxidation chamber. In this case, the extraction zones must be disposed at the top of the chamber and the inert gas and the main oxidant must be heated at a temperature superior to that of the strip in order to move up. The lateral openings are similarly disposed downstream of the oxidant flow.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

REFERENCE SYMBOLS (1) Annealing furnace
(2) Reaction section, also called reaction chamber, and, in particular, oxidation section or chamber
(3) Lateral opening for injecting the inert gas, also called inert gas opening
(4) Transversal opening for injecting the reactant, and in particular the oxidant, also called reactant opening
(5) Strip or sheet
(6) Reinforcement in the transversal opening
(7) Extraction opening
(8) Sealing roll
(9) Zinc bath
(10) Heating means
(11) Valve

The invention claimed is:

1. A continuous annealing furnace for annealing a steel strip, the continuous annealing furnace comprising:

a reaction chamber configured to receive the steel strip in a vertical direction, wherein the steel strip extends in a plane defined by the vertical direction and a horizontal direction perpendicular to the vertical direction, the reaction chamber including:

reactant openings supplied with a reactant and configured to supply the reactant to the reaction chamber, the reactant openings being located at a top or bottom of the reaction chamber in the vertical direction, two lateral sides, and inert gas openings supplied with an inert gas and configured to supply the inert gas to the reaction chamber, the inert gas openings being located on each of the two lateral sides of the reaction chamber, each respective one of the two lateral sides of the reaction chamber being located in the horizontal direction from a respective edge of the steel strip, wherein a width of the reaction chamber in the horizontal direction is greater than a width of the steel strip in the horizontal direction such that the reaction chamber includes two lateral regions, each respective lateral region extending, in the horizontal direction, between a respective edge of the steel strip and a corresponding one of the two lateral sides of the reaction chamber wherein the inert gas openings located on each of the two lateral sides of the reaction chamber are configured to inject inert gas into each of the two lateral regions in order to decrease a concentration of the reactant in each of the two lateral regions wherein the reaction chamber further includes a first seal at the entry point of the steel strip at one of the top or bottom of the reaction chamber and a second seal at the exit point of the steel strip at the other of the top or bottom of the reaction chamber, wherein the first seal and the second seal are configured to separate an atmosphere of the reaction chamber from a remainder of the furnace, and wherein the first seal and the second seal are configured to minimize flow of the reactant supplied by the reactant openings and flow of the inert gas provided by the inert gas openings to the remainder of the furnace.

2. The furnace of claim 1, wherein the inert gas openings are located in such a way as to be downstream of reactant flow from the reactant openings.

3. The furnace of claim 1, comprising one or several inert gas openings on each lateral side of the reaction chamber.

4. The furnace of claim 1, further comprising:

control valves and a heater configured to control a flow and temperature of the inert gas.

5. The furnace of claim 1, further comprising:

control valves configured to separately control a flow of the inert gas on each lateral side of the reaction chamber.

6. The furnace of claim 1, wherein the reaction chamber further includes extraction openings configured to avoid an overpressure inside the reaction chamber, wherein the extraction openings are located in such a way as to be downstream of reactant flow and inert gas flow respectively leaving the reactant openings and the inert gas openings.

7. The furnace of claim 1, wherein a distance, in the horizontal direction, between a respective one of the two lateral sides of the reaction chamber and a corresponding proximal edge of the steel strip is in a range of from 75 to 220 mm.

8. The furnace of claim 1, wherein the reaction chamber includes a reactant opening facing each side of the steel strip.

9. The furnace of claim 1, wherein the reaction chamber is an oxidation chamber and the reactant is an oxidant.

10. A method for using the furnace of claim 1 to control a surface reaction on a steel strip running vertically through the reaction chamber, the method comprising:

injecting laterally the inert gas in the reaction chamber; and injecting a reactant upstream of an inert gas flow in the reaction chamber.

11. The method of claim 10, wherein the reaction chamber is an oxidation chamber and the reactant is an oxidant, wherein an oxygen content of the oxidant is in a range of from 0.01 to 8% in volume.

12. The method of claim 10, wherein the inert gas flow is in a range of from 5 to 70 $Nm^3/h$.

13. The method of claim 10, wherein the inert gas temperature is between 200 and 50° C. below a steel strip temperature when a reaction of the steel strip is performed by injecting the reactant at a top of the reaction chamber, and wherein the inert gas temperature is between 200 and 50° C. above the steel strip temperature when the reaction of the steel strip is performed by injecting the reactant at a bottom of the reaction chamber.

14. The method of claim 10, further comprising:

extracting a gas comprising the inert gas and the reactant, extracted flow being calculated based on a difference of pressure between an inside of the reaction chamber and other parts of the furnace.

15. The furnace of claim 1, wherein each of the two lateral sides intersects the plane defined by the vertical direction and the horizontal direction.

16. The furnace of claim 1, wherein each respective edge of the steel sheet extends in the vertical direction and defines an extent of the steel sheet in the horizontal direction.

* * * * *